United States Patent [19]

Beyl et al.

[11] Patent Number: 4,488,734

[45] Date of Patent: Dec. 18, 1984

[54] SKI BRAKE

[75] Inventors: Jean J. A. Beyl; Jean Bernard, both of Nevers; Christian Campillo, Garchizy; René Guerreau, Montmarault; Daniel le Faou, Varennes Vauzelles; Henri Peyre, Nevers, all of France

[73] Assignee: Ste Look, Paris, France

[21] Appl. No.: 581,212

[22] Filed: Feb. 22, 1984

Related U.S. Application Data

[63] Continuation of Ser. No. 267,248, May 26, 1981, abandoned.

[30] Foreign Application Priority Data

Jun. 10, 1980 [FR] France ..... 80 12836

[51] Int. Cl.[3] ..... A63C 7/10

[52] U.S. Cl. ..... 280/605

[58] Field of Search ..... 280/605, 12 AB; 188/5, 188/8

[56] References Cited

U.S. PATENT DOCUMENTS 4,101,145 7/1978 Korger ..... 280/605
4,294,458 10/1981 Sedlmayr ..... 280/605

FOREIGN PATENT DOCUMENTS 2525945 12/1976 Fed. Rep. of Germany ..... 280/605
2920517 1/1980 Fed. Rep. of Germany ..... 280/605

*Primary Examiner*—Joseph F. Peters, Jr.
*Assistant Examiner*—Joseph G. McCarthy
*Attorney, Agent, or Firm*—Jordan B. Bierman

[57] ABSTRACT

The control ends of two pivotal braking arms have elbowed extensions rotatably mounted in bearings provided on or within an operating pedal. In the active braking position of the pivotal arms, the axes of the elbowed extensions form a V having a downwardly-directed point and the braking ends of the pivotal arms are outwardly displaced with respect to each other on each side of the ski. In the withdrawn position, the braking ends are close together and set back with respect to the sides of the ski. However a tension spring tends to produce a pivotal displacement of the operating pedal with respect to the pivotal arms to an angular position such that the braking ends are spaced at a sufficient distance to pass on each side of the ski.

5 Claims, 9 Drawing Figures

SKI BRAKE

This application is a continuation of application Ser. No. 267,248, filed May 26, 1981, abandoned.

This invention relates to ski brakes of the type comprising two arms pivotally mounted about a horizontal axis which is located transversely with respect to the ski.

In ski brakes of this type, the control ends of the pivotal arms carry an operating pedal which is applied flat against the ski when the braking ends of the arms are lifted to a withdrawn position above the ski.

When the ski boot is in position on the ski, said boot applies pressure on the operating pedal, thus maintaining the braking ends of the pivotal arms in the raised position of withdrawal. However, the braking ends then project outwards beyond the side edges of the ski. This may in fact constitute a drawback under certain circumstances.

For this reason, some types of ski brakes are so designed that the braking ends of their pivotal arms are drawn closer together above the ski when they are in the raised position of withdrawal. However, the different systems provided up to the present time for the purpose of obtaining withdrawal of the pivotal arms are not wholly satisfactory.

Thus in the brake described in French patent application No. 75 07899 granted under No. 2,272,695, withdrawal of the braking arms is obtained by applying tension to the wire which constitutes these latter, this being achieved by means of a drawing device constituted by a kind of toggle joint which is intended to be flattened by the pressure of the ski boot. However the operation of a system of this type is unreliable. In fact, since the wire constituting the braking arms has to be sufficiently rigid to permit effective braking and to prevent any danger of deformation of the braking arms under the action of simple impacts, it is necessary to exert a large force in order to deform a wire of this type. It is for this reason that the pressure exerted is very often insufficient to obtain satisfactory operation.

In the brake described in French patent application No. 76 11752 published under No. 2,308,389, withdrawal of the braking arms to the raised position is obtained by exerting pressure on a small deformable plate or articulated quadrilateral placed beneath the ski-boot location. In fact, the arrangement is such that flattening of said small plate or articulated quadrilateral causes the two braking arms to move towards each other after they have been lifted to the position of withdrawal.

However, if the control plate is a curved strip, the strip exerts a high pressure beneath the ski boot and is thus liable to interfere with the conditions of ski boot disengagement at the time of release of the binding which retains the boot on the ski. Moreover, if the control plate consists of an articulated quadrilateral, the system provided is particularly complicated and costly. It should further be noted that this system is unreliable, all the more so as its operation is sensitive to frost.

In the brake described in French patent application No. 75 34137 granted under No. 2,330,419, withdrawal of the braking arms is obtained by the action of one or a number of ramps which can be carried by an auxiliary pedal. However, since withdrawal of the arms results from deformation of the wire constituting these latter, it is necessary to exert a very large force in order to achieve this result. Furthermore, this system also gives rise to parasitic stresses which interfere with the conditions of disengagement of the ski boot in the event of release of the ski binding.

In yet another solution, withdrawal of one braking arm can be obtained by causing this latter to pivot within a bearing whose axis is located in a plane which is transverse with respect to the ski and inclined with respect to the top face of this latter (as shown in FIG. 11 of French patent application No. 73 17074 published under No. 2,228,506). A system of this type has the advantage of extreme simplicity. In contrast, it has a disadvantage in that the least deformation of the braking arm is liable to cause frictional contact and even jamming against the side face of the ski since withdrawal of the arm takes place at the same time as its upward displacement. A further disadvantage lies in the fact that, in order to obtain a movement of withdrawal over a sufficient distance, it is necessary to ensure that the pivotal-arm bearing is located at a relatively high level, which is unacceptable if the brake is placed beneath the ski boot.

Thus the various systems proposed up to the present time for causing withdrawal of the braking arms are all subject to considerable disadvantages. It is for this reason that the aim of the present invention is to provide a ski brake in which withdrawal of the braking arms is obtained by means of a simple, reliable and inexpensive system which exerts a negligible parasitic thrust beneath the ski boot.

Said brake is of the type in which provision is made for two arms pivotally mounted about a horizontal axis located transversely with respect to the ski, the control ends of said arms which are opposite to the braking ends being adapted to carry an operating pedal which is applied flat against the ski when the braking system is in the withdrawn position.

The distinctive feature of the ski brake, however, lies in the fact that the control ends of the pivotal arms have elbowed extensions rotatably mounted in bearings provided on or within the operating pedal. The shape of said extensions as well as the shape of the pivotal arms are such that, in the opened-out position of the braking system, said extensions form a V, the point of which is directed downwards and the braking ends are outwardly displaced on each side of the ski whereas, in the withdrawn position, said braking ends are close together and set back with respect to the sides of the ski. Moreover, a resilient restoring member tends to produce a pivotal displacement of the operating pedal with respect to the pivotal arms to an angular position such that the braking ends of said arms are spaced apart to a sufficient extent to pass on each side of the ski. This change of relative spacing results from a variation of the angle formed between the operating pedal and the pivotal arms.

Thus as soon as the pressure exerted by the ski boot on said pedal is relieved, the braking ends of the pivotal arms are outwardly displaced with respect to each other to a sufficient extent to ensure that said ends can take up their active braking position. Conversely, when a ski boot is returned to its normal position on the ski, this has the initial effect of displacing the braking system in pivotal motion until the braking ends of the pivotal arms are located above the level of the ski. This is followed by a relative pivotal displacement of the operating pedal to a position such that the braking ends of said arms are placed close together in an inwardly withdrawn position.

In an advantageous embodiment, the bearings provided on the operating pedal are mounted in such a manner as to be pivoted to said pedal by means of two pivot-pins located in the longitudinal direction. The advantage of this arrangement lies in the fact that there is thus no longer any need to provide a relatively substantial thickness for the operating pedal.

Other features and advantages of the ski brake according to the invention will be more apparent upon consideration of the following description and accompanying drawings, wherein.

Figure 1:
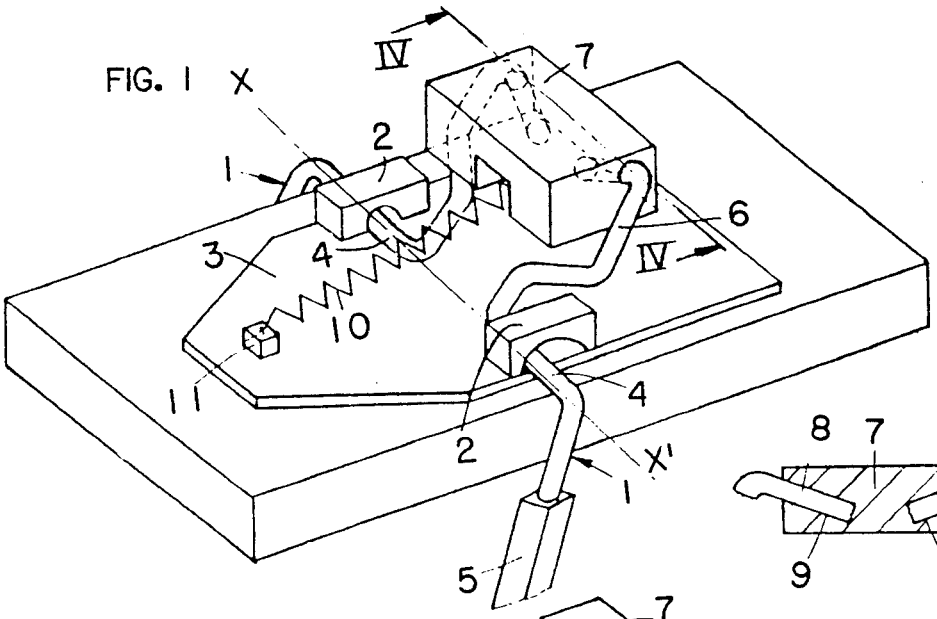
FIGS. 1, 2 and 3 are views in perspective of the ski brake according to the invention, the brake system being shown respectively in the active braking position, in the intermediate position of simple upward displacement of the braking arms and finally in the position of complete withdrawal of said arms.

The ski brake illustrated in FIGS. 1 to 4 comprises two arms 1 which are made of wire and capable of pivotal displacement about a horizontal axis x-x′ which is located transversely with respect to the ski. Said arms are mounted in two bearings 2 carried by a base plate 3, an elbowed portion 4 of each pivotal arm being engaged within the corresponding bearing with a certain degree of freedom of displacement.

The braking end of each pivotal arm is preferably provided with a shoe 5 in order to ensure enhanced braking efficiency. The opposite ends 6 of said arms can be designated as "control ends" and are adapted to carry an operating pedal 7 against which the corresponding ski boot is applied when this latter is in position.

Said pedal is pivotally mounted on the corresponding control ends of the arms 1. With this objective, said control ends are provided with elbowed extensions 8 whilst the operating pedal is provided with two bores 9 which serve as bearings for said extensions.

Figure 3:
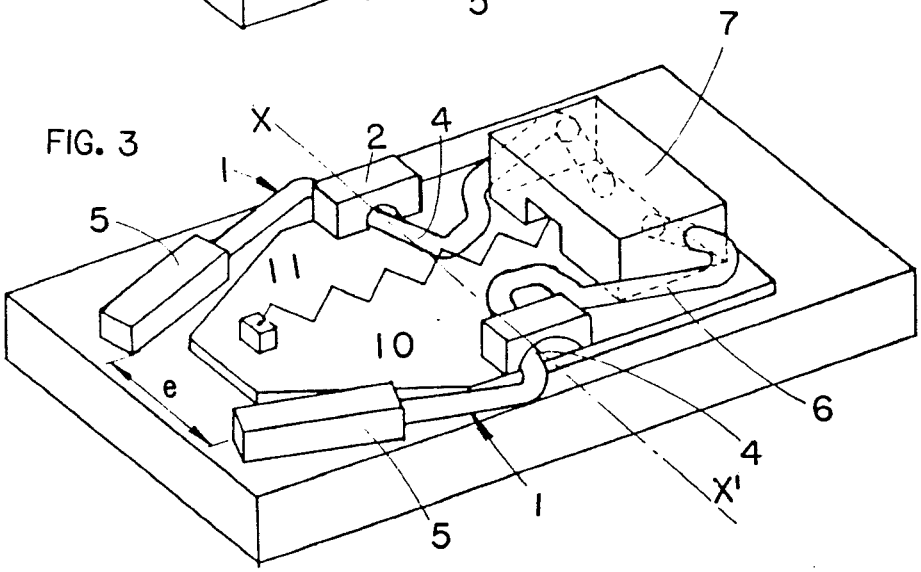
Figure 6:
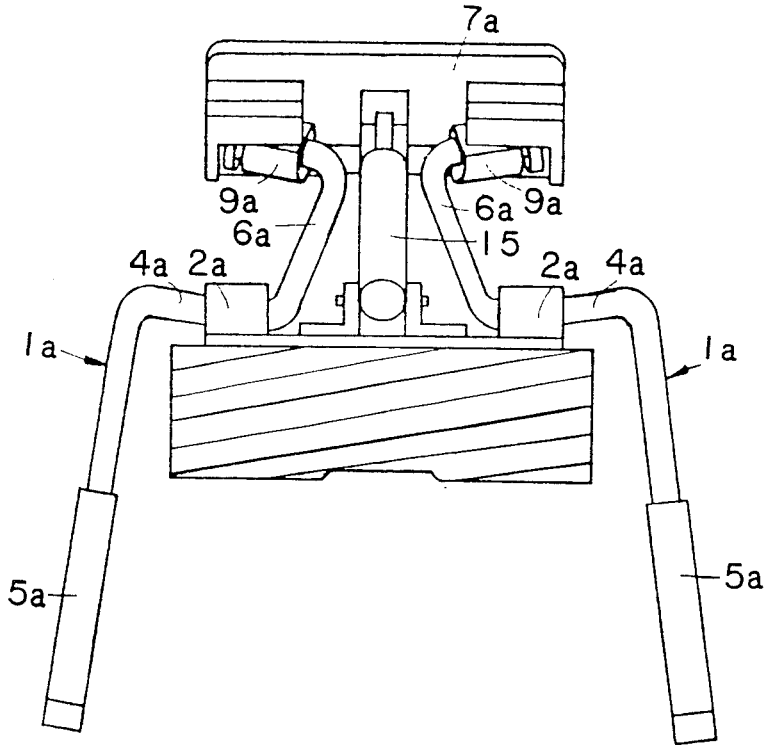
FIG. 6 is an end view in elevation taken along line VI—VI of FIG. 5.
Figure 5:
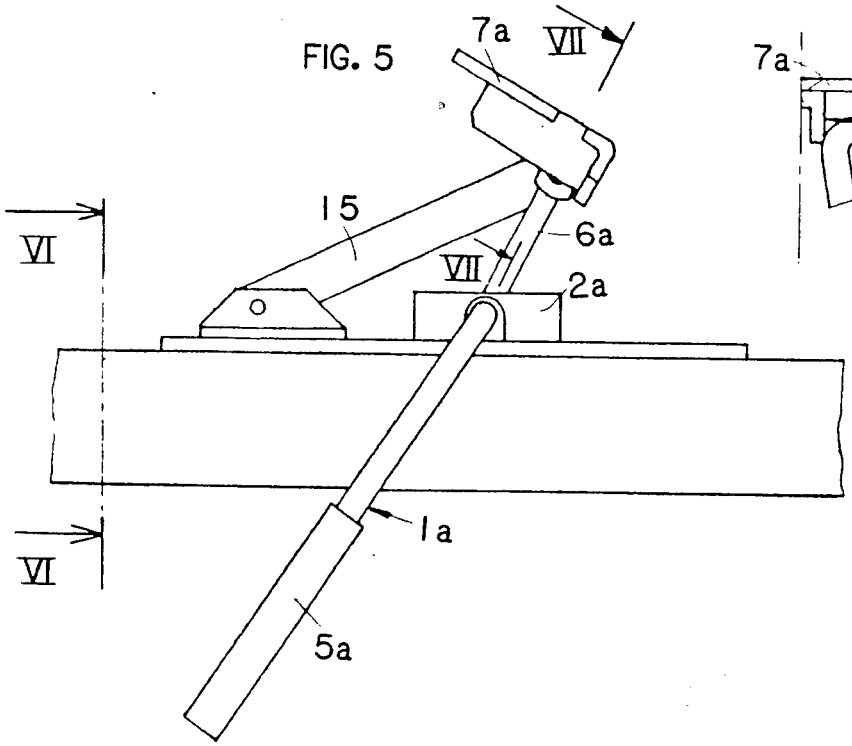
FIG. 5 is a view in side elevation of another embodiment of the ski brake according to the invention.
Figure 7:
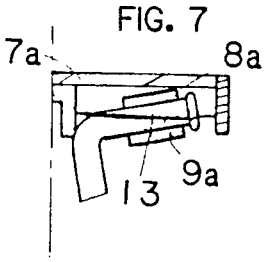
FIG. 7 is a fragmentary sectional view of a detail, this view being taken along line VII—VII of FIG. 5.
Figure 8:
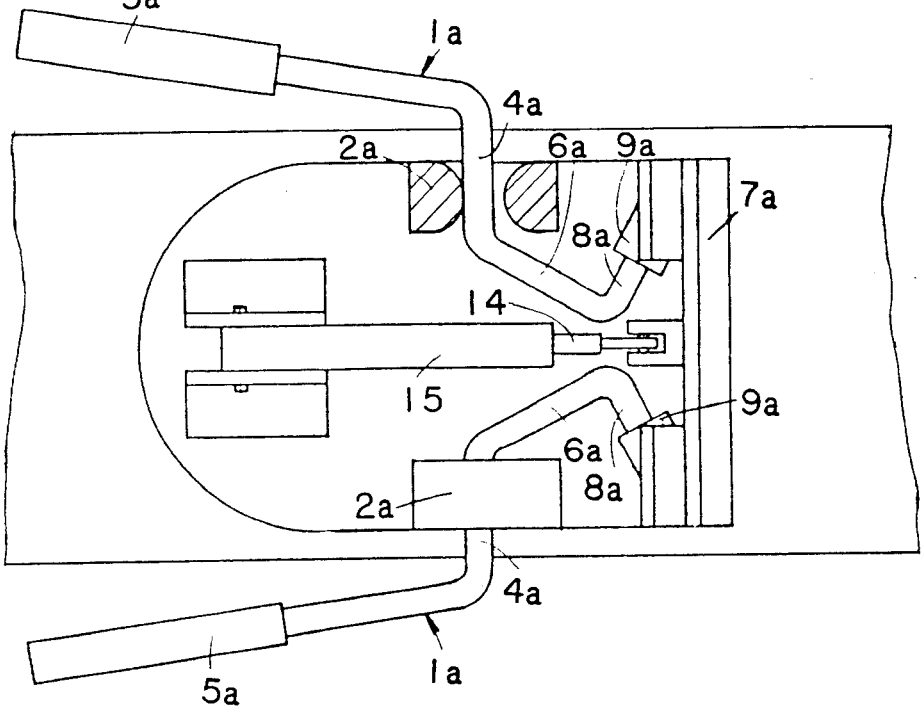
FIGS. 8 and 9 are cutaway plan views of said second embodiment as seen from above, the ski brake being shown respectively in the intermediate operating position and in the withdrawn position.

By virtue of the fact that they are pivoted about the axis x-x′, the pivotal arms are capable of taking up two different end positions, namely a position of readiness which is shown in FIG. 3 and in which their braking ends are withdrawn above the ski, and an active braking position which is illustrated in FIG. 1 and in which said braking ends project beneath the ski whilst the control ends. are in the raised position above the ski.

Figure 4:
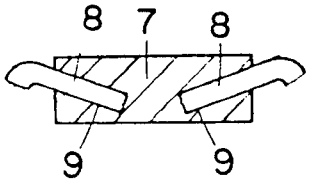
FIG. 4 is a fragmentary sectional view of a detail, this view being taken along line IV—IV of FIG. 1.

In accordance with an essential feature, the axes of the elbowed ends 8 of the pivotal arms form a V, the point of which is directed downwards when said arms are located in their outwardly displaced position shown in FIGS. 1 and 4, the axes of the bearings 9 formed within the thickness of the pedal 7 being located in accordance with the same positional arrangement. In point of fact, the shape of the pivotal arms and of their elbowed extensions 8 are such that, in this position, the braking ends 5 are set at the maximum relative spacing on each side of the ski. In the example shown in the drawings, each pivotal arm is accordingly constituted by an elbowed length of wire, the different parts of which are located in the same plane and the braking end extends substantially at right angles with respect to the elbowed extension 8 of the control end. Under these conditions, the braking ends are outwardly displaced to the maximum extent with respect to each other when they are in the downwardly-directed position and when the pedal is in the raised position with respect to the pivotal arms.

However, the variation of the angle formed between the operating pedal and the pivotal arms causes a modification of the outward slope of the braking ends and consequently a variation in relative spacing of said braking ends. Thus a reduction of the angle aforesaid produces a reduction of the relative spacing of the braking ends 5. The arrangement is such that, in the withdrawn position of the braking system, the relative spacing e between the braking ends is smaller than the width of the ski, with the result that said braking ends are set back with respect to the sides of the ski.

Finally, the ski brake under consideration comprises a single restoring member which produces action on the operating pedal 7 and tends to cause both the relative pivotal displacement of the operating pedal with respect to the arms 1 and the pivotal displacement of these latter with respect to the ski. Said restoring member consists of a tension spring 10, one end 11 of which is fixed on the mounting plate 3. The opposite end of said restoring spring is attached to the operating pedal 7 at a point 12 which is located below the level of the bearings 9.

Figure 2:
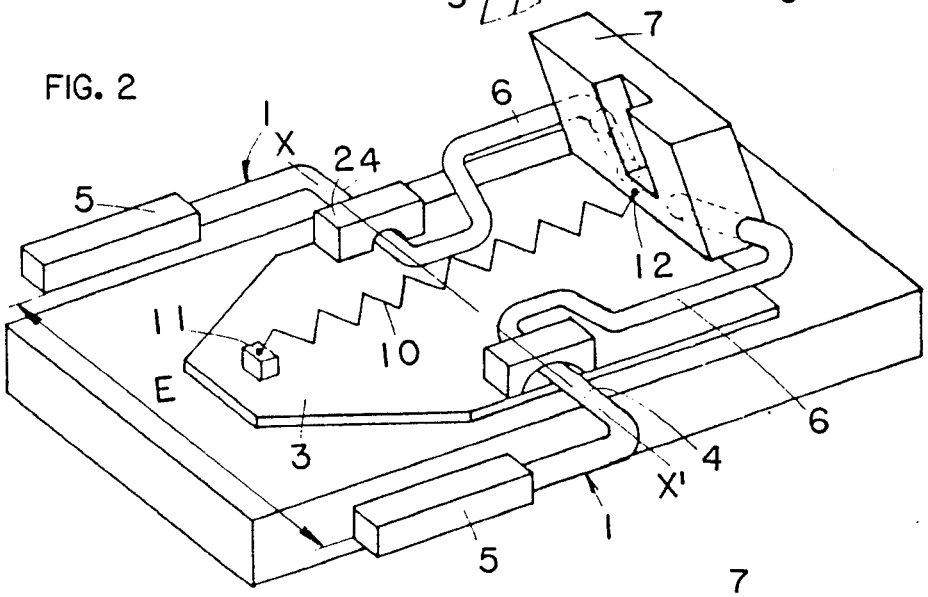

Assuming that the ski brake is in the withdrawn position shown in FIG. 3, the operation of the braking system is as follows:

Immediately upon upward withdrawal of the ski boot which had hitherto been applied against the operating pedal 7, said pedal tends to undergo a movement of pivotal displacement on the elbowed extensions 8 of the braking arms 1 under the action of the restoring spring 10. Said pedal thus takes up the raised position shown in FIG. 2, even before the arms 1 have begun their movement of pivotal displacement about the transverse axis x-x′. In point of fact, the pivotal movement of the pedal 7 with respect to the general plane formed by the two arms 1 produces the relative outward displacement of the braking ends of said arms as shown in FIG. 2. It will be readily understood that, during this operation, the elbowed portions 4 of said arms are caused to carry out a movement of angular displacement within the fixed bearings 2 of the mounting plate.

In the position thus occupied by the arms 1 and from that time onwards, the braking ends of said arms have a relative spacing E which exceeds the width of the ski. Under these conditions, the arms are capable of passing freely on each side of the ski. In fact, the action of the spring 10 then tends to displace the arms 1 in pivotal motion about the axis x-x′ until they take up the active braking position shown in FIG. 1.

Conversely, when the ski boot is downwardly restored to its normal position on the ski, the pressure exerted on the pedal 7 tends to initiate a pivotal displacement of the braking system about the axis x-x′. At the end of this displacement, however, the pressure applied by the boot produces a relative pivotal displacement of the pedal 7 with respect to the control ends 6 of the arms 1, thus ensuring that said pedal is once again applied flat against the ski. In point of fact, the relative pivotal movement of the pedal has the effect of producing a relative inward displacement of the braking ends 5 of the pivotal arms. The relative spacing of said arms is then reduced to its value e at which their braking ends are set back with respect to the corresponding sides of the ski. However, it is worthy of note that this movement of withdrawal of the braking ends takes place only after these latter have been fully raised in order to prevent any interference with this movement of upward displacement.

FIGS. 5 to 9 illustrate another embodiment of the ski brake according to the invention. The difference between this form of construction and the preceding embodiment lies in the fact that the bearings in which the elbowed extensions 8*a* of the control ends of the pivotal arms are rotatably mounted are constituted by sleeves 9*a* pivotally mounted on the corresponding operating pedal 7*a* and no longer consist of bores formed directly within the thickness of this latter. In practice, the pins 13 on which said two sleeves are pivotally mounted are placed in the longitudinal direction.

The arrangement just described makes it possible to reduce the thickness of said pedal. In fact, at the end of the movement of withdrawal of the braking system, the two bearings 9*a* are capable of pivotal displacement about the pins 13 in order to come into a position in which they are parallel both to the ski and to the operating pedal.

In other respects, however, the structure of the corresponding brake remains the same as in the embodiment described earlier. Thus each pivotal arm la is provided at an intermediate point of its length with an elbowed portion 4*a* which is engaged with a certain degree of freedom of displacement within a fixed bearing 2*a*. Furthermore, the operating pedal 7*a* is subjected to the action of a restoring member. In the example shown, said restoring member consists of a traction rod 14 actuated by a spring contained within a cylinder 15.

Under these conditions, the operation of said brake is the same as in the previous embodiments. In fact, as soon as the ski boot is moved away from the pedal 7*a*, the action of the restoring member initiates a relative pivotal displacement of this latter with respect to the plane formed by the two arms 1*a*. The result thereby achieved is a change of orientation of the bearings 9*a* and of the elbowed ends 8*a*, thus causing the braking ends 5*a* of the pivotal arms to open-out in the position shown in FIG. 8. The action of the restoring member 14 then causes the braking system to undergo a movement of pivotal displacement to the position shown in FIGS. 5 and 6 in which the braking ends are located in the active braking position.

Figure 9:
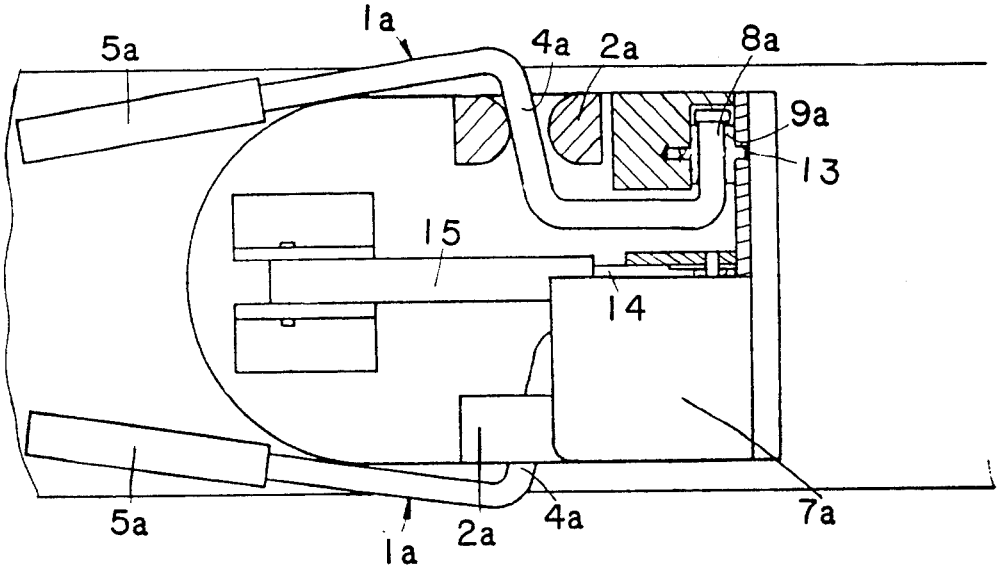

Conversely, as soon as the ski boot is returned to its normal position on the operating pedal 7*a*, this has the effect of displacing the braking ends 5*a* in the upward direction to a position located above the level of the ski, then of producing a movement of relative pivotal displacement of the pedal 7*a* with respect to the plane of the two braking arms. Now the movement of pivotal displacement just mentioned has the effect of bringing the braking ends closer together until they reach their fully withdrawn position as shown in FIG. 9, in which said braking ends are set back with respect to the corresponding sides of the ski.

As already mentioned in this case, however, there takes place at the end of the operation a pivotal movement of the bearings 9*a* with respect to the operating pedal 7*a* so that said bearings take up a position which is substantially parallel to the top surface of the ski. Under these conditions, the overall height of the operating pedal is relatively small, which is not the case in the previous embodiment according to FIGS. 1 to 4, in which the bearings 9 were formed within the thickness of the operating pedal.

It will remain clearly apparent that the ski brake according to the invention is not limited to the two examples which have been described in the foregoing solely by way of indication. Thus the resilient restoring member which produces action on the operating pedal could be designed differently. If necessary, this single member could be replaced by two separate restoring members, one member being adapted to control the relative pivotal movement of the operating pedal with respect to the braking arms and the other restoring member being adapted to control the pivotal movement of said arms with respect to the ski.

What is claimed is:

1. In a ski boot operated ski brake comprising a pair of pivoting brake arms disposed symmetrically on one and the other side of the ski, said brake arms each having an individual braking end portion movable toward a lower nonretracted braking position and a raised retracted nonbraking portion, an opposite control end portion supporting a control pedal between them, and an integral bent portion intermediate said end portions and pivotally mounted on the ski with angular play in the ski plane in the transverse direction, and spring means urging said arms into their nonretracted braking position, the improvement in which said control pedal is formed as a box-like member having a top flat surface for receiving the bottom of said ski boot and in which said spring means is formed as a unit distinct from said control pedal but connected at one end to said ski at the other end to the underside of said pedal, and comprising means forming an elbowed extension at the end of each control end portion of each brake arm, and means forming bearings within opposite sides of said control pedal respectively supporting said elbowed extensions and forming the sole means for guiding said control pedal relatively to said ski, said pedal in its nonretracted braking position extending in a plane at an angle to the plane of said braking end portions with the axes of the respective bearing means and the end elbow extensions forming a V lying in a plane perpendicular to said top flat surface of the control pedal and having a downwardly directed point, whereby upon depression of said pedal under action of the ski boot against the extendible action of said spring means, the intermediate bent portion of each brake arm in the pedal-depressed position of the brake shifts in its pivoted mounting on the ski to move the brake end portions into a retracted position with respect to the ski edges.

2. A ski brake according to claim 1, in which said pedal is formed as a solid block and in which the means forming said bearings are bores within said block.

3. A ski brake according to claim 2, in which said pedal is formed with a longitudinal slot in its bottom surface and in which said spring means is connected to the front end of said pedal through said slot.

4. A ski brake according to claim 1, in combination with pivot pins extending longitudinally of the ski within opposite transverse sides of said pedal, and means respectively mounting the means forming said bearings on said pivot pins.

5. In a ski boot operated ski brake comprising a pair of pivoting brake arms disposed symmetrically on one and the other side of the ski, said brake arms each having an individual braking end portion movable toward a lower nonretracted braking position and a raised retracted nonbraking portion, an opposite control end portion supporting a control pedal between them, and an integral bent portion intermediate said end portions and pivotally mounted on the ski with angular play in the ski plane in the transverse direction, and spring means urging said arms into their nonretracted braking position, the improvement in which said control pedal is formed as a box-like member having a top flat surface for receiving the bottom of said ski boot and in which said means is formed as a longitudinally stretchable member having one end connected to said ski and the other end to the underside of said pedal, and comprising means forming an elbowed extention at the end of each control end portion of each brake arm, and means forming bearings within opposite sides of said control pedal respectively supporting said elbowed extensions and forming the sole means for guiding said control pedal relatively to said ski, said pedal in its nonretracted braking position extending in a plane at an angle to the plane of said braking end portions with the axes of the respective bearing means and the end elbow extensions forming a V lying in a plane perpendicular to said top flat surface of the control pedal and having a downwardly directed point, whereby upon depression of said pedal under action of the ski boot against the extendible action of said spring means, the intermediate bent portion of each brake arm in the pedal-depressed position of the brake shifts in its pivoted mounting on the ski to move the brake end portions into a retracted position with respect to the ski edges.

* * * * *